US006758257B2

(12) United States Patent
Lee

(10) Patent No.: US 6,758,257 B2
(45) Date of Patent: Jul. 6, 2004

(54) READILY CUSTOMIZABLE BLIND SET

(76) Inventor: Han-Sen Lee, 98-1, Show-Tsuo St., Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 0 days.

(21) Appl. No.: 09/861,397

(22) Filed: May 17, 2001

(65) Prior Publication Data

US 2002/0170686 A1 Nov. 21, 2002

(51) Int. Cl.[7] ..... E06B 9/26

(52) U.S. Cl. ..... 160/166.1 R; 160/168.1 R; 160/172.2 R

(58) Field of Search ..... 160/166.1 R, 168.1 R, 160/168.1 V, 173 R, 178.1 R, 178.2 R

(56) References Cited

U.S. PATENT DOCUMENTS 4,662,596 A * 5/1987 Haarer ..... 248/251
5,263,528 A * 11/1993 Patel ..... 160/178.2
5,339,716 A * 8/1994 Sands et al. ..... 83/452
6,062,292 A * 5/2000 Bryant ..... 160/178.1 R
6,079,306 A * 6/2000 Liu ..... 83/454
6,098,694 A * 8/2000 Ohanesian ..... 160/168.1 V
6,148,894 A * 11/2000 Judkins ..... 160/177 R
6,253,823 B1 * 7/2001 Swopes et al. ..... 160/168.1 R
6,263,945 B1 * 7/2001 Nien ..... 160/173 R
2002/0170686 A1 * 11/2002 Lee ..... 160/166.1

* cited by examiner

*Primary Examiner*—Bruce A. Lev
(74) *Attorney, Agent, or Firm*—Curtis L. Harrington

(57) ABSTRACT

The structures and process of both forming and trimming the blind set include the provision of a channel extension or channel plug utilized in a blind set which has the louver manipulation components significantly inward to permit a reasonable amount of outboard removal while maintaining the balance and regular appearance of the blind set. The channel plug acts to stabilize the "U" shaped upper channel by having an insertion portion which not only fills a structurally significant extent of the channel, but fully upwardly engages a pair of oppositely oriented curved inwardly and downwardly lips. An extension portion of the channel plug has a pair of upper rails which match and blend with the terminus of the pair of oppositely oriented curved inwardly and downwardly lips to provide both stability, visual continuity, and continuous upper, frontal, rear, and bottom support as will be had from the particular mounting method employed. The plug is typically made from a material as soft as the material from which the louvers or slats are made, such as wood, plastic, polyethylene, polyurethane, nylon, fiber glass, polypropylene, or the like.

15 Claims, 3 Drawing Sheets

READILY CUSTOMIZABLE BLIND SET

FIELD OF THE INVENTION

The present invention relates to an improvement in the window covering which is efficient and enables individuals to have the facilitated ability to customize the width of horizontal blinds and reduce injury and damage to the horizontal blinds being custom fitted, as well as to reduce the danger to the individual performing the custom sizing of the blind sets.

BACKGROUND OF THE INVENTION

Horizontal blind systems typically have an upper channel made of metal and configured to support movement and bearing components for horizontal blind operation. The two main operations are the elevation of the bottom horizontal which automatically collects the suspended horizontals above it and clears the window opening, and the angular movement of the slats utilized to allow light into the room at high or low angle or to close the louvers completely. The first operation is typically had by simply pulling a set of two or more suspension strings downward to, in a pulley fashion cause the bottom member to rise to collect the louvers. The second operation may be actuated by a pair of pull strings, or more recently by a control wand, to enable the louvers to change their angle. Thus the inside channel has to support bearing members for raising of the louver and a rotational drum for adjusting the angle of the louvers by raising and lowering two louver support verticals relative to each other.

Typically the louvers or slats are made of a soft material such as wood, plastic, nylon or other carbon based material. Further, in most horizontal blind sets, the upper channel is made of steel or aluminum. Even where very expensive and high precision saws are available, the cutting of the complex shape of the channel is extremely problematic. The saw used for metal and the saw used for the soft material, as a practical matter, have to be different. Cutting the soft material with a metal cutting saw would burn or melt the soft material, while cutting the metal with a soft material saw would rip and tear the metal, bending the upper channel and leaving sharp bits of metal torn away from the channel. The so-called soft material is in reality a material of soft cutting consistency which takes to account the fact that a saw typically takes larger bites of the material, proceeds much more quickly through the material, with the saw blade being typically configured to avoid generation of friction on the material at points past the cutting front. Metal saws are generally characterized as having teeth which take much smaller bites, and since the material to be cut is metal, any friction generated by the saw blade, as well as by the cutting teeth, are assumed to be readily dissipated especially by the metallic material, as well as by extended length of the cutting blade, especially in the case of a band saw. These are general characteristics of commonly available saw blades, and it is understood that a given blade may or may not have combinations of the specific characteristics enumerated.

The reaction to these problems has not been satisfactory. Attempting to select an intermediate type saw still carries the dangers of burn to the soft material and ripping to the channel. Further, any attempt to cut both the metal channel and the soft louver material simultaneously would be dangerous to the operator. Both the metal and the soft material have their own blades and the cutting operation proceeds at different speeds for each. The further unacceptable result is in trying to cut them separately. This means that the louvers or slats have to become dis-aligned from the channel, and that the cutting operation of each has to come within inches of the other. Further, when dis-aligned, or "fanned" to a small extent, and thus when not stacked together, the likelihood of a mis-match in dimension is high. The point of customization is not only for the blind set to fit an odd sized window, or even that the channel simply clear the width in which it is to be mounted. The point is to have a blind set which fits squarely into a window opening, and in which the louvers or slats have a fit within the window which appears custom and which shuts out light. Blind sets which are mounted outside of an opening and which are not custom fit can overlap the opening to affect the shutting out of light, however, this orientation is more likely to leave a gap between the side wall facings and the closed louvers or slats to thus provide an even greater impediment to sealing off of light.

What is therefore needed is a mechanism which allows blind sets having relatively soft louver or slat material to be more safely, rapidly and easily customized, and without the need for using different types of saw blades, and without the need to separate the channel from the louvers to cause either a mismatch in size or to cause an angled cut due to "fanning". The needed solution should strengthen and stabilize the blind set while reducing the changes for size error and mis-match.

SUMMARY OF THE INVENTION

The structures and process of both forming and trimming the blind set include the provision of a channel extension or channel plug utilized in a blind set which has the louver manipulation components significantly inward to permit a reasonable amount of outboard removal while maintaining the balance and regular appearance of the blind set. The channel plug acts to stabilize the "U" shaped upper channel by having an insertion portion which not only fills a structurally significant extent of the channel in a shape which is substantially continuous with the external dimensions of the channel, but fully upwardly engages a pair of oppositely oriented curved inwardly and downwardly lips and fully downwardly engages the floor of the channel to form a rigid fit with respect to the channel. Moreover, the act of closely engaging the internal aspects of a "U" shaped channel by a rigid block structure even further bolsters the strength and stability of the channel alone, as well as further providing an even stronger structure at the end or ends of the channel. The strength bolstered end, regardless of the length to which it is cut, enables a more creative variety of wall supports, especially supplanting wall supports which were believed necessary to completely surround and engage the channel on a plurality of its corners or sides.

An extension portion of the channel plug has a pair of upper rails which match and blend with the terminus of the pair of oppositely oriented curved inwardly and downwardly lips to provide both stability, visual continuity, and continuous upper, frontal, rear, and bottom support as will be had from the particular mounting method employed. The plug is typically made from a material as soft as the material from which the louvers or slats are made, such as wood, plastic, polyethylene polyurethane, polyvinyl chloride, polystyrene, medium density fiber board, plywood, fiber glass, polypropylene, paper or the like. The plug contains a pair of internal guide ribs to assist the engagement of a small threaded member which extends through the lower floor of the "U" shaped upper channel, and then engaging the plug at a surface adjacent such lower floor. The plug may have one or more edges or corners removed to reduce the effective perimeter of the end of the insertion portion to facilitate quicker insertion of the plug into the "U" shaped upper channel.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
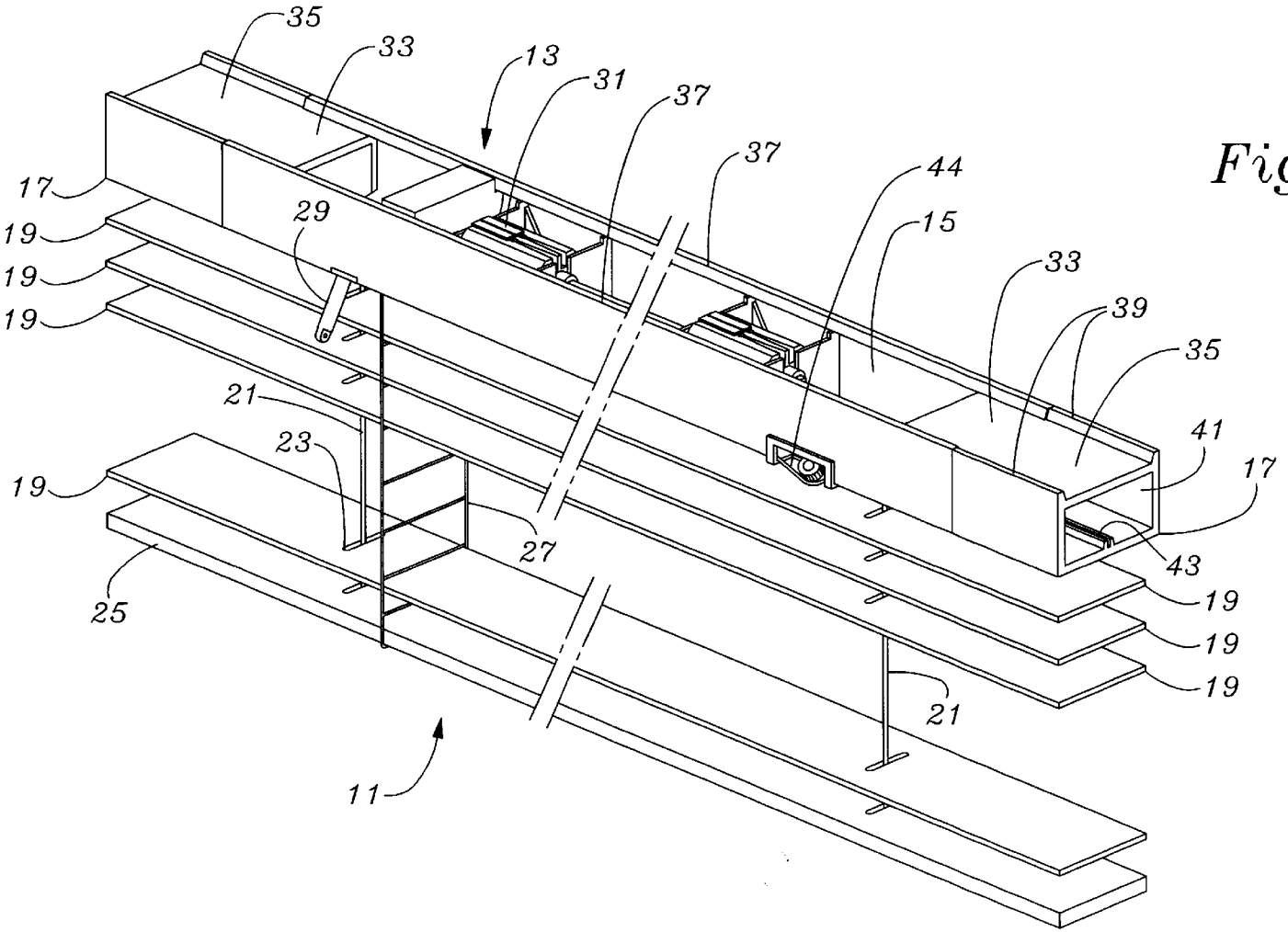
FIG. 1 illustrates a perspective view of a customizable blind set showing a horizontal break line to illustrate that it can be of any overall length, and having an interruption in the vertical stack of its slats to show that it can be of any height having any number of slats, and showing the integral channel plugs at the ends of the upper channels.

The description and operation of the shutter system of the invention will begun to be best described with reference to FIG. 1 which illustrates a perspective view of a customizable blind set 11. Blind set 11 has an upper channel member 13 which includes a metal "U" shaped upper channel 15 and a channel plug 17.

Below the upper channel member 13, a series of louvers or slats 19 are suspended along a set of string or pull cords 21 through a series of apertures 23. The lowest, underneath the set of slats 19 is a base slat 25, typically used by its size and weight to anchor the slats 19 above it, and to provide a space for termination of a ladder cord. A ladder cord 27 is shown which may extend generally along side the pull cords 21 but need not do so, and is shown spaced from the pull cords for clarity. The ladder cord 27 suspends the louvers in a spaced apart relationship when the pull cord is loosened enough to allow the louvers to spread into the spacing set by the ladder cord.

A turning fitting 29 is seen protruding at an angle from the channel 15 which operates the appropriate gearing to operate the ladder cord 27. Inside the metal "U" shaped upper channel 15 is a pair of drums 31, each of which operates a ladder cord 27, one of which is seen in FIG. 1. Each drum 31 engages the two vertical ends of the ladder cord 27 across its width and the turning of the drum 31 causes the louvers or slats 19 to change its planar angle to let in more or less light. The drums 31 are rotationally supported within the are metal "U" shaped upper channel 15, but are significantly inboard of the outermost extent of the metal "U" shaped upper channel 15, at least inboard enough to give sufficient space to accommodate the channel plug 17 on either end. The pull end of the set of pull cords 21 are not shown for clarity and especially as they can emerge and extend downwardly form several places on the upper channel member 13. The turning of the drums 31 can be accomplished by use of a wand and its turning gear or by a further set of pull cords, but where the downwardly extending cords are brought further inboard, the use of a wand and reduction gear is preferred.

The channel plug 17 is seen to have an insertion portion 33 which extends inboard of the outermost extent of the metal "U" shaped upper channel 15, and an extension portion 35 which extends outboard of the outermost extent of the metal "U" shaped upper channel 15. In FIG. 1, the only view of channel plug 17 illustrates a continuous surface which is not directly engaging any other structure. As will be seen, in order to achieve continuity with the channel member 13, the surfaces which will abut the inside of the channel member 13 will have a small but discrete size differential roughly equivalent to the thickness of the metal utilized for channel member 13. The metal "U" shaped upper channel 15 has a pair of oppositely oriented curved inwardly and downwardly lips 37. The lips 37 have an exterior surface which is generally seen in FIG. 1 and an interior surface generally facing a floor of the channel member 13 which will be more fully seen in FIG. 2. The channel plug 17 includes a pair of upper flanges 39 which continue this shape onto the channel plug 17 beyond the outermost extent of the metal "U" shaped upper channel 15. The result is that a pair of pair of oppositely oriented curved flange shapes extend the length of the top of the upper channel member 13 throughout its length. This structure makes a flat profile and urges the upper channel member 13 to become flatly resting against any upper flat surface. The channel plugs 17 are seen to have an open end 41 extending through them, and a pair of threaded member raised walls 43. A pull cord mechanism 44 is seen for enabling the pulling through and selective locking of the position of a pull cord (not shown).

Figure 2:
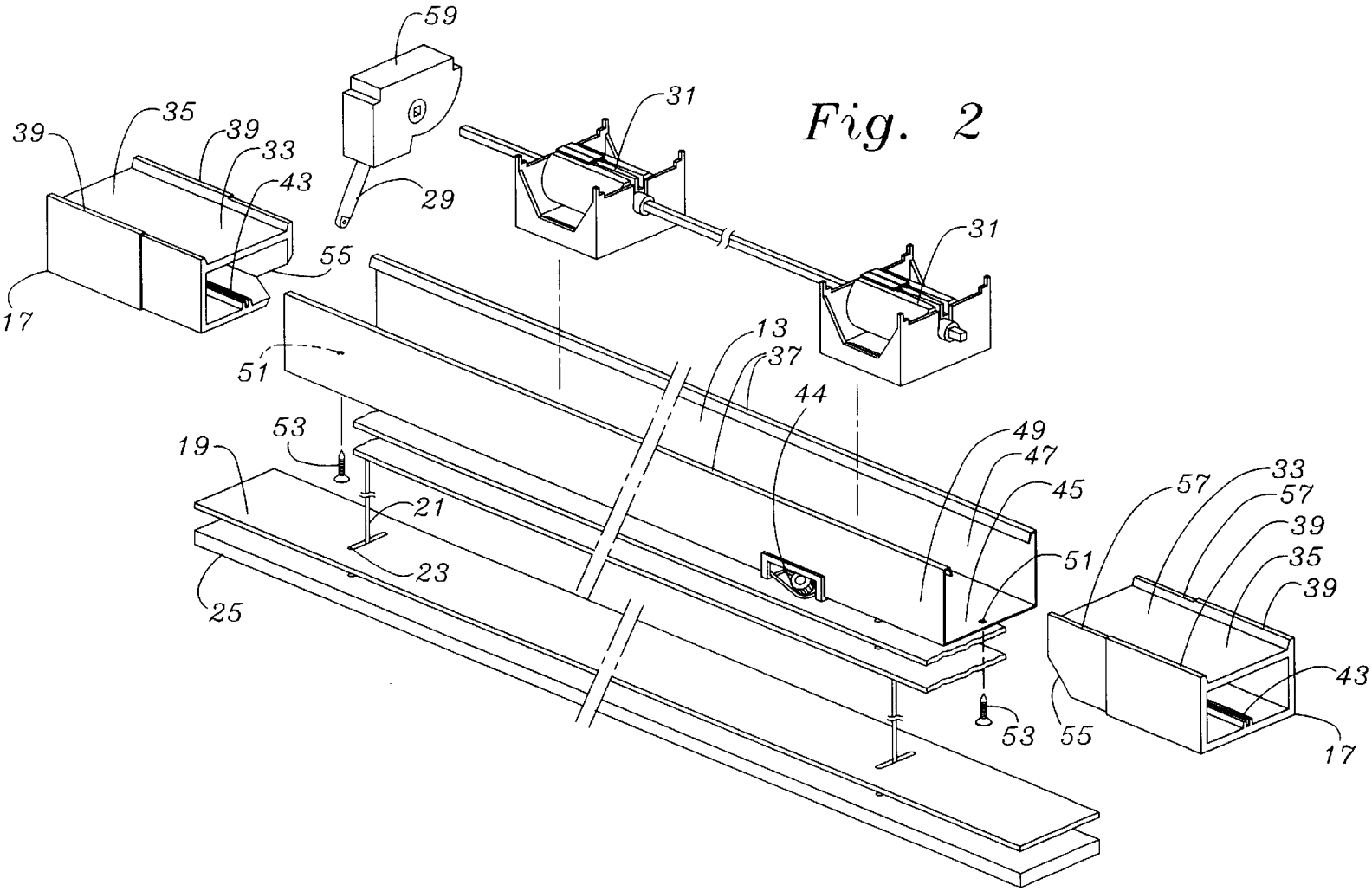
FIG. 2 is a view taken from the same perspective as in FIG. 1, but with the upper channel internals removed, and with the integral fitting channel plugs shown exploded from the the "U" shaped upper channel.

Referring to FIG. 2, a view from the same perspective as FIG. 1 is shown but in which the internals of the metal "U" shaped upper channel 15 have been removed and in which the channel plugs 17 are shown in exploded relation ship more fully illustrates the construction. The metal "U" shaped upper channel 15 is seen to have a floor 45, a first side wall 47 and a second side wall 49. An aperture 51 in the floor 45 is utilized by a small threaded member 53 in order to securely engage the channel plug 17 in its sliding fit within the The metal "U" shaped upper channel 15. Because the insertion portion matches the internal confines of the "U" shaped upper channel 15, a very close fit is maintained simply by the small threaded member 53.

The channel plug 17 is also shown as having a small corner removed to yield a cut away shape 55 to assist in inserting the channel plug 17 into the "U" shaped upper channel 15 by permitting an initial entry alignment. It is to be noted that since the channel plug 17 is a rectangular annulus that the cut away shape 55 will simply create a "v" shaped angled surface on the floor 45 and second side wall 49 as shown. As also can be seen, the pair of upper flanges 39 transition into a pair of abbreviated height rounded flanges 57 which are sized to fit underneath the pair of oppositely oriented curved inwardly and downwardly lips 37 of the "U" shaped upper channel 15. A gear box 59 is seen operably attached to the turning fitting 29, and set to operate turning linkages between turning gear box 59 and the connected drums 31.

Figure 3:
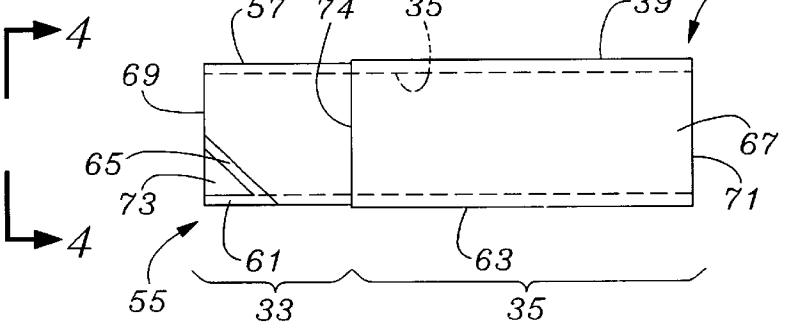
FIG. 3 is a side view of the channel plug seen in FIGS. 1 and 2 and illustrating the abbreviated height rounded flanges which fit within the underside of a pair of oppositely oriented curved inwardly and downwardly lips at the top of a "U" shaped upper channel, typically made of metal.

Referring to FIG. 3, a side view of the channel plug 17 is seen and which illustrates one portion of the "v" as a cut 61 into a floor wall 63, and the other portion of the "v" as a cut 65 into a first side wall 67. Other features of the channel plug 17 include a first end 69 of the insertion portion 33, and a second end 71 of the extension portion 35. A small portion of a second side wall 73 can be seen through the 55 in the cut away shape 55. Further, a surface normal to the extent of the channel plug 17 is seen as normal planar surface 74, so called as it is normal to the axis of the general directional extent of the channel plug 17. The cylindrical equivalent to normal planar surface 74 would be a radial surface. The width of this normal planar surface 74 is approximately the thickness of the metal of the channel member 13, but it need not always be. So long as provision is made for the insertion portion 33 to gain strong, rigid support from the channel member 13, the exterior surface of the insertion portion 33 need not match the channel member 13 internal surface. Regardless, the normal planar surface 74 acts as but one mechanism to solidly set the extent to which the second end 71 of the channel plug 17 extends beyond the end of the channel member 13. This means that there will be no axial movement with respect to the channel member 13, and the cutting of the channel plug 17 will then have the same effect dimensionally in the axial direction of the channel member 13 as if the channel itself were being cut. As has already been discussed, it is an important advantage that the channel plug 17 act to stabilize the end of the channel member 13, and any deviation from a design wherein the insertion portion 33 does not match the channel member 13, should ideally still provide this stabilization of the channel member 13.

Figure 4:
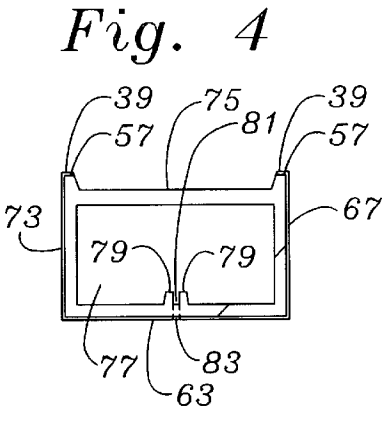
FIG. 4 illustrates an end view of the channel plug of FIG. 3 and illustrating internal detail.

Referring to FIG. 4, an end view taken along line 4—4 of FIG. 3 is seen. A top wall 75 is seen between the abbreviated height rounded flanges 57 and the pair of upper flanges 39. The top wall 75, first side wall 67, second side wall 71 and floor wall 63 form an annular rectangular shape and may be molded or extruded as a one piece extrusion. The abbreviated height rounded flanges 57 can be formed from a full extrusion by simply grinding off a very small amount of additional material over a portion of the plug 17 which is to be inserted into the "U" shaped upper channel 15, namely, the insertion portion 33.

The annular rectangular shape of the plug 17 includes a through opening 77. At the center of the floor wall 63, a pair of slightly spaced apart up upwardly extending protrusions 79 provide a guide slot 81 for assisting in providing a guide for the insertion of the threaded member 53. The material of the protrusions 79 provide holding power for the threaded member 53. The formation of the protrusions 79 may also be used as a safety valve for the excess of the material of the plug where it is desired to provide same. The protrusions 79 and the guide slot 81 assist in both the entry and the holding force for the threaded member 53. An aperture 83 is seen in dashed line format.

Figure 5:
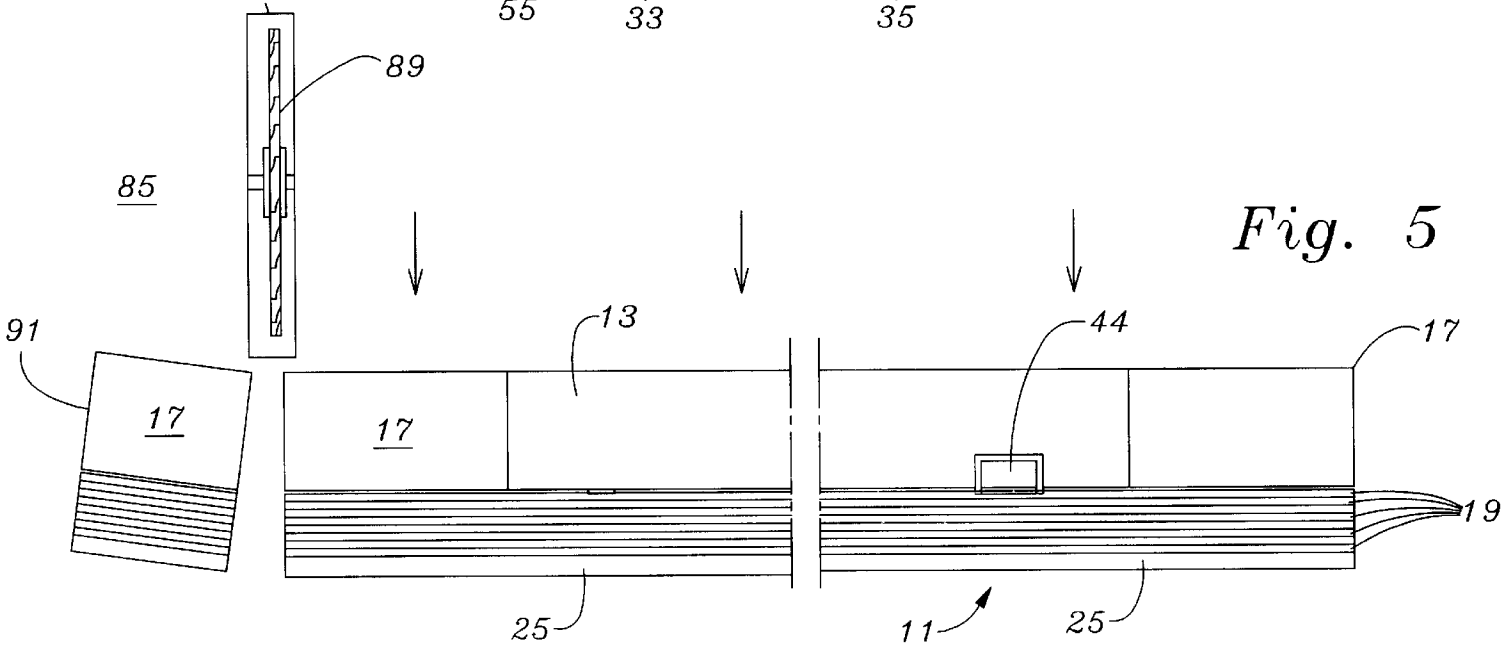
FIG. 5 illustrates a plan view of the customizable blind set looking down upon a cutting table with protruding circular saw and shown in a position having just been cut.

Referring to FIG. 5, a plan view of the customizable blind set 11 looking down upon a cutting table 85 having a blade opening 87 and circular saw blade 89. The arrows indicate the direction of travel across the cutting table 85. Note that for stability purposes, the louvers or slats 19 are bunched closely to the channel member 13. This enables the louvers or slats 19 to derive support from each other, the channel member 13 and the base slat 25. The bunching may be done by use of string, elastic bands, clamps and the like.

The customizable blind set 11 is having one of its ends cut after having had the other of its ends cut to leave equal lengths of channel plug 17. The blind set 11 is extremely compacted with the base slat 25 compressing the louvers 19 tightly against the "U" shaped upper channel 15. The ability to form a simultaneous cut of the louvers 19, base slat 25 and channel plug 17, all made of substantially material of the same softness, while the blind set 11 is in such a tight packed arrangement, greatly adds to the accuracy of the cut.

As has been discussed, this also greatly adds to safety. Cutting a tight packed assembly, possibly temporarily held together by bands, ties or a clamp is essentially as safe as cutting a relatively large block of homogeneous material. Without the ability to cut under conditions of tight pack, the separate members would have to be held together separately. This is either done well and is onerous, or it is done poorly and could result in one of the slats 19 becoming ripped up from the group and destroyed. At best destroyed slat 19 requires almost complete disassembly of the blind set 11 and replacement of the ladder cord 27. At worse, a shattering of the material being cut could harm the operator. The time savings also benefits the user as the concentration of interest is the width of the window covering or blind set 11 and this is exactly what a cutting table 85 is set up to do. The view of FIG. 5 illustrates the treatment just after the last cut where a grouping of cut excess 91 is seen separated from the remaining blind set 11. The cut excess 91 may preferably be banded together by tape or elastic band to hold it together during cutting, if the cut excess is long enough, especially to prevent movement of significant sized chips in, around and through the blade opening 87. Note that both of the channel plugs 17 are of fairly equal length, but this is not strictly a requirement. The blind set 11 can be utilized with only a single channel plug 17, especially if a resulting bilateral symmetry is not especially desired. In blind sets 11 with more than two sets of ladder cord 27, the interspacing between ladder cords 27 can be staggered to hide or obscure un-evenness in the end cuts.

While the present invention has been described in terms of a system and method for quickly and accurately simultaneously cutting a blind set by utilizing end protrusions of the same material cutting resistance of the slats or louvers, one skilled in the art will realize that the structure and techniques of the present invention can be applied to many structures, including any structure or technique where a firmly anchored extension can be provided within the same dimensional limit as other material to be trimmed.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A customizable blind set comprising:

a channel having a first end and a second end;

a plurality of at least one of louvers and slats connected to said channel by at least one of a pull cord and a ladder cord;

at least one channel plug rigidly attached within and extending beyond said first end of said channel, for substantially continuing an outer dimension of said channel, and wherein a cutting softness of said plurality of at least one of louvers and slats connected to said channel, and said channel plug extent beyond said first end of said channel facilitates simultaneous cutting by a single saw blade.

2. The customizable blind set as recited in claim 1 wherein said channel is made of metal.

3. The customizable blind set as recited in claim 1 and further including at least one of a drum and a pull cord.

4. The customizable blind set as recited in claim 1 wherein said at least one channel plug has substantially an overall rectangular annular shape.

5. The customizable blind set as recited in claim 4 wherein said substantially overall rectangular annular shape of said at least one channel plug includes a top wall, bottom wall, first side wall and second side wall, and wherein an inside surface of said bottom wall includes a pair of spaced apart protrusions for guiding an insertion into said locking threaded member.

6. The customizable blind set as recited in claim 1 wherein at least one of said plurality of at least one of louvers and slats, and said at least one channel plug is made from at least one of wood, plastic, polyurethane, nylon, fiber glass, and polypropylene.

7. The customizable blind set as recited in claim 1 wherein said at least one channel plug includes an insertion portion which is insertable into said channel, and an extension portion, adjacent said insertion portion, and continuing beyond said first end of said channel.

8. The customizable blind set as recited in claim 7 wherein said channel includes a curved lip having an inwardly directed surface and wherein said channel plug insertion portion includes a rounded flange having an upper portion which engages said inwardly directed surface of said curved lip.

9. The customizable blind set as recited in claim 1 wherein said channel has an overall "U" shape having a pair of opposite ends when viewed transversely, said ends being continuous along an extent of said channel, and shaped as curved lips having an interior surface and exterior surface and wherein said lips engage said channel plug.

10. The customizable blind set as recited in claim 9 therein said channel plug includes a curved lip having an inwardly directed surface and wherein said channel plug insertion portion includes a rounded flange having an upper portion which engages said inwardly directed surface of said curved lip.

11. The customizable blind set as recited in claim 10 wherein said channel plug curved lip includes an outwardly directed surface and wherein said channel plug extension portion includes at least one flange continuous with said outwardly directed surface of said curved lip.

12. The customizable blind set as recited in claim 1 wherein said channel includes an aperture and further comprising a threaded member passing through said aperture and engaging said at least one channel plug in its rigid attachment to said first end of said channel.

13. The customizable blind set as recited in claim 1 wherein said at least one channel plug is a first channel plug and further comprising a second channel plug supported at said second end of said channel so that both said first and said second channel plugs may be trimmed simultaneously with a pair of ends of each of said plurality of at least one of louvers and slats so that said blind set may be evenly bilaterally cut.

14. A process for customizing a blind set having a channel having a first end and a second end and having a plurality of at least one of louvers and slats connected to said channel by at least one of a pull cord and a ladder cord and at least one channel plug rigidly attached within said channel and at said first end of said channel, the step of simultaneously cutting said channel plug and said plurality of at least one of louvers and slats without cutting said channel, said at least one of said pull cord and said ladder cord.

15. The process for customizing a blind set having a channel as recited in claim 14 wherein said plurality of at least one of louvers and slats are closely bunched to said channel during said step of simultaneously cutting said channel plug and said plurality of at least one of louvers and slats.

* * * * *